US009447557B2

(12) United States Patent
Schiffmann et al.

(10) Patent No.: US 9,447,557 B2
(45) Date of Patent: Sep. 20, 2016

(54) FOOTER, FOOTER ELEMENTS, AND BUILDINGS, AND METHODS OF FORMING SAME

(71) Applicant: Composite Panel Systems, LLC, Eagle River, WI (US)

(72) Inventors: Glenn P. Schiffmann, St. Germain, WI (US); Daniel J. Wojtusik, Eagle River, WI (US)

(73) Assignee: Composite Panel Systems, LLC, Eagle River, WI (US)

( * ) Notice: Subject to any disclaimer, the term of this patent is extended or adjusted under 35 U.S.C. 154(b) by 0 days.

(21) Appl. No.: 14/626,817

(22) Filed: Feb. 19, 2015

(65) Prior Publication Data

US 2015/0240441 A1 Aug. 27, 2015

Related U.S. Application Data

(60) Provisional application No. 61/943,123, filed on Feb. 21, 2014.

(51) Int. Cl.
*E02D 27/00* (2006.01)
*E02D 27/01* (2006.01)
(Continued)

(52) U.S. Cl.
CPC ..... *E02D 27/01* (2013.01); *E02D 27/08* (2013.01); *E02D 31/00* (2013.01); *E02D 2250/0015* (2013.01); *E02D 2300/0046* (2013.01)

(58) Field of Classification Search
CPC ..... E02D 27/01; E02D 27/08; E02D 2300/0046; E02D 2250/0015
USPC ..... 52/169.5, 299, 293.3, 169.14, 293.1
See application file for complete search history.

(56) References Cited

U.S. PATENT DOCUMENTS 584,865 A 6/1897 Fisher
1,045,521 A 11/1912 Conzelman
(Continued)

FOREIGN PATENT DOCUMENTS

AU 3286778 8/1979
EP 0984118 3/2000
(Continued)

OTHER PUBLICATIONS

Unknown Author, Superior Walls Xi Foundation System, www.superiorwalls.com/images/XiWall_lg.jpeg, Printed May 2, 2005, 1 page.
(Continued)

*Primary Examiner* — Basil Katcheves
*Assistant Examiner* — Joshua Ihezie
(74) *Attorney, Agent, or Firm* — Thomas D. Wilhelm; Northwind IP Law, S.C.

(57) ABSTRACT

Footer products, and footers made with such products. Such product includes an insulating member between its upper and lower surfaces. The upper surface receives a load. The interior transfers the load from the upper surface to the lower surface, and distributes the load laterally and longitudinally such that the load received at the lower surface is within the load-bearing capacity of underlying soil. The product provides a thermal shock barrier between underlying soil and the interior of the building. The insulating member can comprise the entirety of the product, or can be combined with top and/or bottom load distributing layers, or can be combined with intercostals which extend top-to-bottom through the foam. Such footers are useful in constructing structures which use footers to spread the overlying load onto a greater surface area of the underlying soil than the cross-section area of the structure which presents the load to the footer.

14 Claims, 4 Drawing Sheets

(51) Int. Cl.
*E02D 27/08* (2006.01)
*E02D 31/00* (2006.01)

(56) References Cited

U.S. PATENT DOCUMENTS

| | | | | |
|---|---|---|---|---|
| 1,857,926 | A | | 5/1932 | Mason et al. |
| 1,858,701 | A | | 5/1932 | Boettcher |
| 2,074,483 | A | | 3/1937 | Mason et al. |
| 2,128,539 | A | | 8/1938 | Roach |
| 2,204,319 | A | | 6/1940 | Parsons et al. |
| 2,915,150 | A | | 12/1959 | Weidler |
| 2,950,786 | A | | 8/1960 | Markle |
| 3,107,755 | A | | 10/1963 | Thibert |
| 3,216,163 | A | | 11/1965 | Carew |
| 3,282,001 | A | | 11/1966 | Bigalow |
| 3,287,866 | A | | 11/1966 | Bevilacqua |
| 3,490,186 | A | | 1/1970 | Hammond |
| 3,601,942 | A | | 8/1971 | Wilson |
| 3,662,507 | A | | 5/1972 | Espeland |
| 3,685,241 | A | | 8/1972 | Cooper |
| 3,898,115 | A | | 8/1975 | Watkins et al. |
| 4,058,941 | A | | 11/1977 | Zakrzewski et al. |
| 4,125,980 | A | | 11/1978 | Miraldi |
| 4,189,125 | A | | 2/1980 | Little |
| 4,229,919 | A | | 10/1980 | Hughes |
| 4,236,362 | A | * | 12/1980 | Omholt ..... 52/223.6 |
| 4,275,538 | A | | 6/1981 | Bounds |
| 4,310,992 | A | | 1/1982 | Thabet |
| 4,328,651 | A | | 5/1982 | Gutierrez |
| 4,439,959 | A | | 4/1984 | Helfman |
| 4,464,873 | A | | 8/1984 | Geiger |
| 4,569,167 | A | | 2/1986 | Staples |
| 4,580,487 | A | | 4/1986 | Sosnowski |
| 4,653,239 | A | | 3/1987 | Randa |
| 4,689,926 | A | * | 9/1987 | McDonald ..... 52/169.11 |
| 4,738,061 | A | | 4/1988 | Herndon |
| 4,833,842 | A | | 5/1989 | Anastasio |
| 4,860,508 | A | | 8/1989 | Jackson et al. |
| 4,988,237 | A | | 1/1991 | Crawshaw |
| 5,359,816 | A | | 11/1994 | Iacouides |
| 5,421,136 | A | * | 6/1995 | Van De Peer ..... 52/294 |
| 5,493,838 | A | | 2/1996 | Ross |
| 5,509,242 | A | | 4/1996 | Rechsteiner et al. |
| 5,526,625 | A | | 6/1996 | Emblin et al. |
| 5,535,556 | A | * | 7/1996 | Hughes, Jr. ..... 52/169.5 |
| 5,535,978 | A | | 7/1996 | Rodriguez et al. |
| 5,547,737 | A | | 8/1996 | Evans et al. |
| 5,572,841 | A | | 11/1996 | Buster |
| 5,615,525 | A | | 4/1997 | Kenworthy |
| 5,657,597 | A | | 8/1997 | Loftus |
| 5,735,090 | A | | 4/1998 | Papke |
| 5,743,056 | A | | 4/1998 | Balla-Goddard et al. |
| 5,758,460 | A | | 6/1998 | MacKarvich |
| 5,761,862 | A | | 6/1998 | Hendershot et al. |
| 5,813,182 | A | | 9/1998 | Commins |
| 5,857,297 | A | | 1/1999 | Sawyer |
| 5,870,866 | A | | 2/1999 | Herndon |
| 5,881,519 | A | | 3/1999 | Newkirk |
| 5,890,334 | A | | 4/1999 | Hughes, Jr. |
| 5,966,881 | A | | 10/1999 | Kitagaki |
| 5,996,296 | A | | 12/1999 | Bisbee |
| 6,041,561 | A | | 3/2000 | LeBlang |
| 6,041,562 | A | | 3/2000 | Martella et al. |
| 6,112,489 | A | | 9/2000 | Zweig |
| 6,120,723 | A | * | 9/2000 | Butler ..... 264/333 |
| 6,125,597 | A | | 10/2000 | Hoffman et al. |
| 6,164,035 | A | | 12/2000 | Roberts |
| 6,176,055 | B1 | | 1/2001 | Fu |
| 6,178,709 | B1 | | 1/2001 | Hertz |
| 6,205,720 | B1 | | 3/2001 | Wolfrum |
| 6,212,849 | B1 | | 4/2001 | Pellock |
| 6,238,766 | B1 | | 5/2001 | Massett et al. |
| 6,244,005 | B1 | | 6/2001 | Wallin |
| 6,256,960 | B1 | | 7/2001 | Babcock et al. |
| 6,367,215 | B1 | | 4/2002 | Laing |
| 6,523,312 | B2 | | 2/2003 | Budge |
| 7,127,865 | B2 | | 10/2006 | Douglas |
| 7,278,240 | B2 | | 10/2007 | Burkart et al. |
| 7,409,800 | B2 | | 8/2008 | Budge |
| 7,694,481 | B2 | * | 4/2010 | Kestermont ..... 52/404.1 |
| 7,926,241 | B2 | | 4/2011 | Schiffmann et al. |
| 8,272,190 | B2 | | 9/2012 | Schiffmann et al. |
| 8,516,777 | B2 | | 8/2013 | Schiffmann et al. |
| 8,607,531 | B2 | | 12/2013 | Schiffmann et al. |
| 8,904,737 | B2 | | 12/2014 | Schiffmann et al. |
| 2002/0197295 | A1 | * | 12/2002 | Stein et al. ..... 424/405 |
| 2003/0056460 | A1 | | 3/2003 | Rivington |
| 2003/0061781 | A1 | | 4/2003 | Smith |
| 2004/0050001 | A1 | | 3/2004 | Williams |
| 2005/0011149 | A1 | * | 1/2005 | Mard ..... 52/292 |
| 2006/0016140 | A1 | | 1/2006 | Smith |
| 2006/0096204 | A1 | | 5/2006 | Martens et al. |
| 2006/0150550 | A1 | | 7/2006 | Summers |
| 2006/0254167 | A1 | | 11/2006 | Antonic |
| 2007/0007402 | A1 | | 1/2007 | Dierkes |
| 2007/0051058 | A1 | * | 3/2007 | Kestermont ..... 52/293.3 |
| 2007/0107370 | A1 | | 5/2007 | Douglas |
| 2007/0266659 | A1 | | 11/2007 | LaPierre |
| 2008/0016795 | A1 | | 1/2008 | George et al. |
| 2008/0047217 | A1 | | 2/2008 | Browning et al. |
| 2008/0127600 | A1 | | 6/2008 | Schiffmann et al. |
| 2008/0307747 | A1 | | 12/2008 | Douglas |
| 2009/0165411 | A1 | * | 7/2009 | Schiffmann et al. ..... 52/309.1 |
| 2010/0307073 | A1 | * | 12/2010 | Oliver et al. ..... 52/169.9 |
| 2012/0085049 | A1 | | 4/2012 | Schiffmann |
| 2013/0284995 | A1 | * | 10/2013 | Myer et al. ..... 256/19 |

FOREIGN PATENT DOCUMENTS

| | | |
|---|---|---|
| EP | 1010817 | 6/2000 |
| FR | 2879633 | 6/2006 |
| GB | 2049781 | 12/1980 |
| GB | 2076872 | 12/1981 |
| WO | 9803736 | 1/1998 |
| WO | 2008070026 | 6/2008 |
| WO | 2010067382 | 6/2010 |

OTHER PUBLICATIONS

Author Unknown, Superior Walls R-5 System, www.superiorwalls.com/images/R5_lg.jpg, Printed May 2, 2005, 1 page.

ICF Direct Incorporated, Performance, Quality, Unmatched Value Insulated Concrete Forms, Received in 2007, brochure, 4 pages.

Lite-Form Technologies, The Beautiful Difference in Concrete begins with Lite-Form, Brochure, Copyright 2004, 8 pages, Published by Lite-Form Technologies, South Sioux City, NE.

Plymouth Foam Inc., Enterprising Product Solutions, Oct. 1, 2003, 4 pages, vol. 1, Issue 3.

Creative Pultrusions, Inc., Transonite Panel System, Product Brochure, Copyright 2012, 5 pages.

Plymouth Foam Inc., Durafill, EPS Geofoam, Versatile, Lightweight Construction Fill, Oct. 2003, 4 pages, Plymouth, WI.

Plymouth Foam Inc., Plymouth, WI, GFR Engineering Solutions, Geofoam: Providing new solutions to old challenges, Copyright 2003, 4 pages, GFR Magazine vol. 19, No. 5, Jun./Jul. 2001.

8 Concrete Reasons to Demand Owens Corning FOLD-FORM Insulating Concrete Forms, Copyright 2004, 6 pages, South Sioux City, Nebraska.

* cited by examiner

FOOTER, FOOTER ELEMENTS, AND BUILDINGS, AND METHODS OF FORMING SAME

BACKGROUND OF THE INVENTION

This invention relates to footers used to support constructed structures.

The general concept of a footer is to spread an overlying load over a large enough area of underlying soil or rock that the load-bearing capacity of the soil or rock is not exceeded.

Specifically, the function of a footer is (i) to receive a downwardly-directed, gravity-initiated force from an overlying load such as a wall, a roof, or the like, (ii) to laterally and longitudinally distribute that load over an area greater than the cross-sectional area of the overlying load/wall at the upper/contact surface of the footer, and (iii) to deliver that so-distributed load to the underlying soil or rock over that greater area, at the lower surface of the footer.

By so distributing the load, and applying the load to the underlying soil over a greater area, the footer does two things. First, the footer distributes any point loads or concentrated loads by spreading such loads over a greater area; which means that the magnitude of the load in any micro area is attenuated. Second, the width of the footer is generally greater than the width of that wall which applies the load onto the footer. By applying the total load to the underlying soil over a greater overall area/width, the load per unit area, as applied to the soil, is generally lower than the load per unit area at the bottom of the wall which applied the load.

Thus, a footer allows the builder to construct a building, and keep that building stable, where the width of the upright wall of the building, as that wall approaches the underlying soil, applies a downward force which exceeds the load-bearing capacity of the soil given the cross-section of the wall which would apply that load to the soil. The footer thus serves as a transition element, and a transfer element, spreading the load over a great enough area of the soil that the soil can bear the load being transferred, without the soil being moved as a result of the load being applied.

Before constructing a building, such as a house, a cottage, a garage, an addition to an existing building, or any of a variety of commercial or industrial type buildings, the contractor first excavates a trench below the surface of the soil. If the structure is to include a basement, the trench will be excavated below and around the outer perimeter of the bottom of what will be the basement floor. The trench dimensions are specified according to the needs of the construction site and the construction project. In cold climates, the trench is usually dug to a depth which extends at least to a depth below the frost line, assuming no basement is first dug. In northern states, such as Michigan, Wisconsin, Minnesota, etc. the frost line is at a depth of about 42 inches. Thus, the bottom of a typical footer in that region, for a residential dwelling, is about 48 inches below grade.

For residential construction, a conventional steel reinforced concrete footer, itself, is about 16 inches wide by 8 inches in height so that such footer can support an overlying conventional exterior concrete wall of the building, which overlying concrete wall is typically about 8 inches thick. Larger size footers are used to support greater overlying loads, e.g. for commercial and industrial buildings, where the overlying e.g. building structure includes thicker and heavier walls, and may include metal crossbeams, where the structure is several stories in height, or where the structure is intended to house and/or support e.g. heavy machinery.

The footer extends around the outer perimeter of the structure and has approximately the same geometrical configuration as the exterior walls which enclose the e.g. building. For example, for a rectangularly-shaped house, a plan view of the footer expresses the footer as having a rectangular shape. Once the trench is dug, the contractor constructs a pair of vertical, spaced apart forms, usually of wood, wherein the tops of the forms terminate at the required height of the footer. Concrete is then poured into the footer forms, up to the tops of the wood forms, and is allowed to harden and cure. After the concrete has hardened, the wood forms are manually removed. The external walls of the building structure can be built upward from the upper surface of the footer once the concrete has cured.

Some drawbacks with this present system of constructing footers are that they are expensive and time consuming to install. Usually, one or two workers are required to construct the wood forms which outline the shape and height of the footer. If the workers are trained carpenters, their wages can be relatively high. Depending on the size of the building, it may take several hours to construct the wood footer forms. A fluid ready-mix concrete truck delivers the fluid concrete for the footer to the work site and again manual labor is needed to move, spread and vibrate the concrete into the wood forms. After the footer is poured, one then has to wait for the concrete to harden/cure before the wood forms can be manually removed. This wait time before the forms can be removed is typically a couple of days. It takes still longer for the concrete footer to fully cure, sometimes up to about 30 days, before one can construct load bearing exterior walls on the so-fabricated footer.

Conventionally, most footers are formed from fluid ready-mix concrete poured into a wood form. A typical footer extends around the outer perimeter of the building to be built. The wood form is manually constructed by carpenters or other skilled labor at the bottom of the trench 16. The wood form includes a pair of spaced apart side walls separated by intermittent spacing members. The length of the footer is specified according to the dimensions of the finished building. The wood at the side walls of the footer form is constructed to a predetermined height, usually about 8 inches above the underlying soil. Vertical studs can be secured to the footer side walls to keep the side walls from moving laterally and intermittent spacing members can extend between the side walls to keep the side walls properly spaced from each other. The wood forms do not include a bottom member or a top member. Fluid ready-mix concrete is poured into the wood form, up to the top surface of the side walls and is leveled off using a straight edge such as a wood 2 by 4. The concrete is usually moved and spread manually with a shovel and then may be subjected to vibration using a special vibration tool to settle the concrete and remove any air bubbles that may have become entrapped in the concrete.

The manual labor needed to construct a wood form and to pour a concrete footer can be rather extensive. Thus, the forming of a concrete footer is both expensive and time consuming. Another drawback to a concrete footer is that one has to wait for the concrete to set and harden before the wood forms can be removed. In addition, concrete takes up to 30 days to fully cure before it can support its full designed load, such as an external wall of the building.

Thus, it would be desirable to provide a footer product which can be emplaced in the footer trench without having to wait for any material to cure or harden before a building load can be applied.

It would also be desirable to provide a footer product which provides a thermal shock barrier.

It would further be desirable to provide a footer product which can be brought to the construction site with others of the non-mineral construction products which will be used to build the above-grade portions of the building.

It would be still further desirable to provide a footer product which is more environmentally friendly than concrete.

These and other needs are provided, or at least partially provided, by footer products of the invention.

SUMMARY OF THE INVENTION

This invention relates to an elongate footer product which includes an elongate insulating member. The elongate footer product has an upper surface and a lower surface, and an insulating member interior between the upper and lower surfaces. The upper surface has the capacity for receiving a load and the interior has the capacity to transfer the load from the upper surface to the lower surface and to cause the load to be distributed laterally and longitudinally, desirably evenly or uniformly, such that the load, as received at any point at the lower surface, is no greater than the load-bearing capacity of the soil or rock underlying such footer product in a constructed structure. The lower surface of the footer product has the capacity to transfer the load to the underlying soil or rock. The footer product also provides a thermal shock barrier between the underlying soil or rock and interior surfaces of the overlying structure. The insulating member can be formed from various materials. Extruded polystyrene foam and expanded bead polystyrene foam can work well as the insulating member, and other insulating materials, including other foamed polymers, are contemplated.

The footer product has a compressive strength, at an acceptable strain, deformation, which is equal to or greater than the compressive strength of the underlying soil, in order that the footer product be able to adequately support the weight of the building constructed thereon.

In a first family of embodiments, the invention comprehends a footer product adapted to receive a given rated load from an overlying construct, the footer product comprising an elongate insulating member having an upper surface, a lower surface, a first side surface, a second side surface, and an interior bounded by the upper surface, the lower surface, and the first and second side surfaces, the insulating member having a length, a width of about 2 inches to about 30 inches, a height of about 4 inches to about 20 inches, and a density of about 10 pounds per cubic foot to about 40 pounds per cubic foot, the footer product exhibiting a strain deformation in height of no more than 10 percent when subjected to the rated load and providing thermal insulation of at least R4 through the height of the footer product.

In some embodiments, the insulating member comprises a foam member extending substantially the full length and the full width of the footer product and the footer product exhibits a strain deformation of no more than 5 percent, optionally no more than 1 percent, when subjected to the rated load.

In some embodiments, the footer product has a height of about 6 inches to about 10 inches.

In a second family of embodiments, the invention comprehends a footer product adapted to receive a given rated load from an overlying construct, the footer product comprising an elongate insulating member having an upper surface, a lower surface, a first side surface, a second side surface, and an interior bounded by the upper surface, the lower surface, and the first and second side surfaces, the footer product having a length, a width of about 4 inches to about 30 inches, a height of 2 inches to about 20 inches, and a density of about 2 pounds per cubic foot to about 40 pounds per cubic foot, and a load distributing member attached to one of the upper surface and the lower surface, the foam member having a first flexural strength at a given height and width, the load distributing member having a second flexural strength, greater than the first flexural strength when having the same height and width.

In some embodiments, the load distributing member comprises a first load distributing member attached to the upper surface, and a second load distributing member attached to the lower surface, the second load distributing member having a third flexural strength, greater than the first flexural strength.

In a third family of embodiments, the invention comprehends a footer product having a top and a bottom, a length and a width, and being adapted to receive and bear a given rated load from an overlying construct, the footer product comprising a foam member having an upper surface, a lower surface, a first side surface, and a second side surface, and an interior bounded by the upper surface, the lower surface, and the first and second side surfaces, the foam member having a length, a width of about 4 inches to about 30 inches, a height of 2 inches to about 20 inches, and a density of about 2 pounds per cubic foot to about 40 pounds per cubic foot; and a plurality of load-bearing intercostals extending through the foam member at multiple locations along the length and width of the foam member, and extending from at or proximate the top surface to at or proximate the bottom surface, the intercostals substantially enhancing load bearing capacity of the footer product.

In some embodiments, the intercostals comprise pins, rods, rivets, and/or needles spaced from each other along the length and the width of the footer member.

In some embodiments, the pins are uniformly spaced from each other along the length and width of the footer product.

In some embodiments, spacing of the pins from each other varies along at least one of the length and the width of the footer product.

In some embodiments, the footer product comprises multiple foam members abutting each other in at least one of side-by-side or end-to-end respective relationships, ones of multiple foam members being wrapped in layers of fibrous material such that layers of fibrous material extend from proximate or at the top of footer product to proximate or at the bottom of footer product such that corresponding portions of layers of fibrous material comprise intercostals.

In some embodiments, a given intercostal extends along a substantial portion of the length or width of the footer product.

In some embodiments, the foam member comprises an elongate foam member extending along the length of the footer product.

In some embodiments, the foam member comprises a plurality of foam members abutting each other end to end and collectively extending along the length of the footer product.

In some embodiments, the plurality of footer members collectively extends along the full length of the footer product.

In some embodiments, a first set of foam members extend across the width of the footer product and abut a first side of the longitudinally-extending foam member.

In some embodiments, a second set of foam members extend across the width of the footer product and abut a second side of the longitudinally-extending foam member.

In some embodiments, a layer of fiber-reinforced polymeric material extends about the longitudinally-extending foam member.

In some embodiments, layers of fiber-reinforced polymeric material extend about ones of the first and second sets of foam members.

In some embodiments, the combination assemblage of the longitudinally-extending foam member and the first and second sets of foam members having a top, a bottom, and first and second sides, further comprising a reinforcing layer of fiber-reinforced polymeric material extending along the length of the assemblage and extending collectively across the top, the bottom, and the first and second sides of the assemblage, thereby to wrap the top, bottom and sides of the assemblage in the fiber-reinforced polymeric reinforcing layer.

Figure 1:
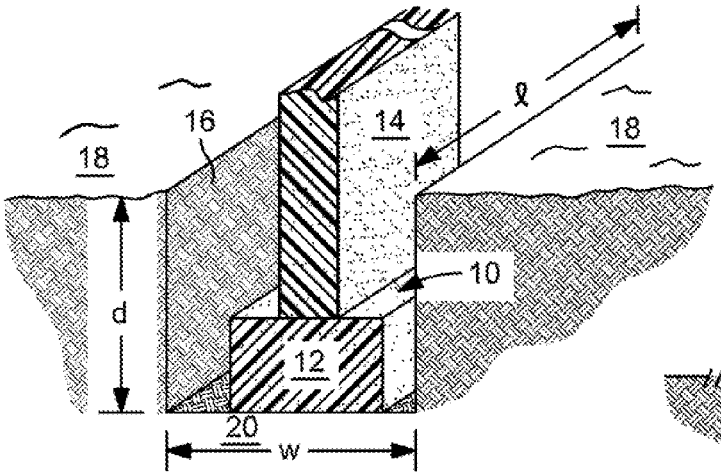
FIG. 1 is a perspective view of a footer in a trench formed in the ground and wherein an exterior wall extends upwardly from the footer.

The invention is not limited in its application to the details of construction, or in the arrangement of the components, or in the specific methods set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

Referring to FIG. 1, the present invention relates to a footer 10 which includes an insulating member 12. A typical footer is utilized to provide support for an external load bearing wall 14 of a building, which bears down on, and is in intimate contact with, the footer, optionally through a thin filler layer. Such footer can also provide support for a load inside the building which separately requires a footer. A trench 16 is first excavated or formed in the ground 18. The depth (d), width (w) and length (l) dimensions of the trench are specified according to the construction plan. The trench 16 is usually excavated to a depth (d) equal to or below the frost line for the particular locale where the building is to be built. In northern states, such as Michigan, Wisconsin and Minnesota, the frost line is at about 42 inches and therefore the trench 16 is typically excavated to a depth (d) of 48 inches. A typical residential footer has a width of about 16 inches. However, the trench is normally dug wider than needed for the footer, itself, in order to provide enough room for construction workers to be able to bodily get in the trench to work. A footer designed for a commercial or industrial building can have greater width and/or height.

Footer product 10 of the invention overcomes certain of the issues relating to conventional concrete footers by using an elongate insulating member 12 as a footer product element. Footer product 10 can be manufactured to various lengths away from the work site. The footer product is then transported to the work site and positioned in the bottom of trench 16. Alternatively, footer product 10 can be manufactured in standard lengths, for example, 8 foot lengths, 10 foot lengths, 12 foot lengths, 20 foot lengths, 40 foot lengths, 60 foot lengths, and all lengths in between. For example, and without limitation, when forming a 40-foot footer, five of the 8 foot length footer products 10 can be positioned end to end to form the required length footer. If a footer product 10 has to be cut to a shorter length, this can easily be accomplished using commercially available cutting equipment.

Insulating member 12 can be formed from various compositions including but not limited to various foamed materials. Examples of suitable foamed materials include polystyrene foam such as extruded polystyrene foam or expanded bead polystyrene foam, polypropylene foam, acrylic foam, rigid urethane foam, polyisocyanurate foam, etc. A polystyrene foam works well in the FIG. 1 embodiment. A closed cell foam is desirable as is a foam having a sufficiently high load bearing capacity, optionally a relatively high compressive strength such as 15-40 pounds per square inch (psi), optionally 25 psi, at 10 percent deformation according to ASTM C165, D1621. In light of the teaching here, those skilled in the art may now become aware of other foams, optionally with greater or lesser compressive strength, depending on the magnitude of the overlying building load, which can be utilized in forming footer product 10, such load to bear down on, and be in intimate contact with, the footer, optionally through a filler layer.

Insulating member 12 can, in the alternative, be a higher density, non-foamed, or slightly aerated material. Such material can be, for example and without limitation, a resin-impregnated fiber-reinforced polymeric composite, an extruded non-foamed or a slightly-foamed polymeric composition. Other examples include certain recycled materials such as crushed glass, recycled plastic, recycled paper or paperboard or cardboard fiber, typically encased in a resin which serves as a binder, and also as a protective encasement where the encased material would be subject to degradation if exposed to soil. Further, the material selection, material composition satisfies the requirement that the resulting footer product provide a thermal shock barrier corresponding to at least R4 through the height of the footer product.

Footer product 10 can include a single, integral-member such as a single foam board. Alternatively, footer product 10 can be formed from two or more e.g. foam or other material boards, foam or other material blocks, foam or other material cores, foam or other material members, etc., and can include foamed or non-foamed top or bottom surface sheets or boards.

When footer product 10 is formed from one of the above recited materials, the footer product can in most instances, including all polymer-only, or polymer and fiberglass only products, be relatively easily cut to fit into a specific portion of the length of trench 16. A collective set of such footer products are laid end to end in the footer trench in forming the entirety of the collective building footer. As desired, a builder can use footer products of the invention in less than all of the building footer, but such is not needed, because where footers of the invention can be successfully used, such as in residential, commercial, and light industrial structures, all, or substantially all of the footer requirements for such application can be met by footers made using footer products of the invention.

Foam-based such insulating members 12 can be readily cut using a manual saw, a circular saw, a ring saw, a skill saw or other kind of cutting tool. Alternatively, a foam-based insulating member 12 can be cut using a thin wire reciprocated back and forth at a high speed. Another way to cut a foam-based insulating member is to subject it to a chemical such as an acid or acetone, which literally melts or dissolves the foam away at the desired location. Those skilled in the foam art are aware of various methods that can be used to cut and/or otherwise shape foam-based insulating members 12.

An insulating member 12 containing a substantial foam fraction is normally inherently moisture resistant, and desirably, is moisture proof. However, it is possible to treat a foam-based insulating member 12, using chemicals or additives to make the insulating member resistant to degradation due to contact with an acid or a base which may be present in the ground. Furthermore, insulating member 12 can be treated to limit or prevent degradation due to contact with foreign substances which may have permeated the ground, for example, oil, gasoline, methane gas, other gases, various kinds of chemical waste, etc.

Footer product 10 which is formed from only a single insulating member 12 is selected according to its physical properties so as to have a compression strength which is equal to or greater than the compression strength of the underlying soil 20 located directly under the footer. Such compressive strength of the footer product assures that the vertical height/thickness of the footer will remain sufficiently stable to meet the needs of the overlying construct for stability while the footer product spreads the overlying load over a sufficiently large area of the underlying soil 20 that the underlying soil 20 can bear the load without the soil moving or shifting. One does not want footer product 10 to move or shift once the footer product is positioned in trench 16, nor after a load-bearing wall 14 is built on the corresponding footer, which load-bearing wall exerts a downward force against the footer; recognizing that such downward force may be accompanied by a lateral force component.

For all footers and footer products of this invention, any kind of lateral support can be used to prevent longitudinal or transverse shifting of the footer product before the building load is applied. For example, conventional wood forms can be used with footers and footer products of the invention, such as the wood forms which are used with poured concrete footers. Such wood forms can extend the full height of the footer product, or less, or more. For example, stakes can be driven through the foam into the underlying soil.

Once the overlying building/wall load is bearing down on the footer product, the wall load is effective, by itself, to prevent most longitudinal or transverse movement of the foam-based footer product.

In northern Wisconsin, the typical load bearing capacity of the soil is around 3,000 pounds per square foot. Different types of soil have different load bearing capacities. The builder determines the load bearing capacity of the soil in which the structure will be constructed before starting construction.

Figure 2:
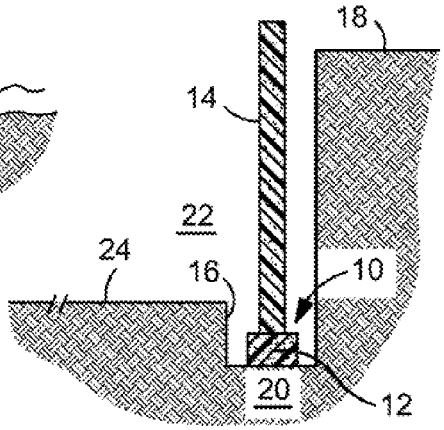
FIG. 2 is an elevation view of an excavated basement, and a footer trench extending about the basement perimeter, and below the ground level of the basement floor, the trench having a footer positioned therein, and a basement wall extending upwardly from the footer.

Referring now to FIG. 2, an elevation view is shown depicting ground 18 as having been excavated to form a basement 22. The surface 24 of the basement floor represents the bottom of the basement space. In this view, trench 16 has been dug to an elevation below the top surface of the basement floor. The typical basement floor has a thickness of about 4 inches to about 6 inches for a residential building, and is formed by pouring fluid ready-mix concrete directly onto the excavated surface of the ground. With footer product 10, comprising insulating member 12, at the bottom of the trench, an external wall 14 which extends vertically upwardly from the resulting footer can be constructed. For example, the external wall shown in FIG. 2 is a foundation wall, a major portion of which is located below ground level 18, also known as being "below grade". External wall 14 can be made from various materials known to those skilled in the art. Examples of various materials which can be used to construct external wall 14 include: poured fluid concrete, concrete blocks, bricks, stone, wood, treated lumber, fiberglass, resin-impregnated fiber-reinforced polymeric (FRP) materials, etc. Specific fiber-reinforced polymeric (FRP) building panels are taught in U.S. Pat. Nos. 7,926,241; 8,272,190; 8,516,777, and in U.S. Ser. No. 13/317,144. The teachings of each such patent and patent application are hereby incorporated by reference in its entirety and are made a part hereof.

Figure 3:
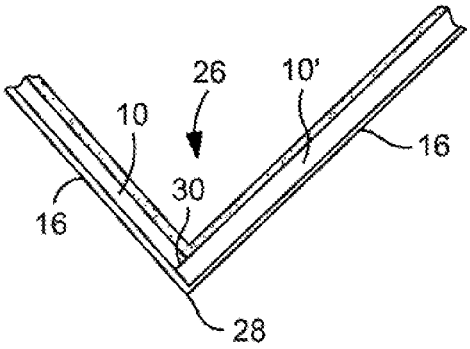
FIG. 3 is a plan view of two trenches meeting at a right angle and having a footer positioned therein.

Referring to FIG. 3, a partial perimeter 26 of a trench 16 is shown having a perpendicular or 90 degree corner 28. In the trench 16, a first footer product 10 having an end 30 contacts the side of a second footer product 10'. Various ways of contacting, securing or abutting adjacent footer products 10, 10' can be utilized. A variety of types of mechanical connections suffice. Examples of such securement are interlocking ends or an interlocking end and side, or separate brackets such as "H" brackets or corner brackets, or elongate supports which extend along the sides of adjacent footer products. The specific connector is determined, at least in part, by the angle at which the abutting footer products meet.

Figure 4:
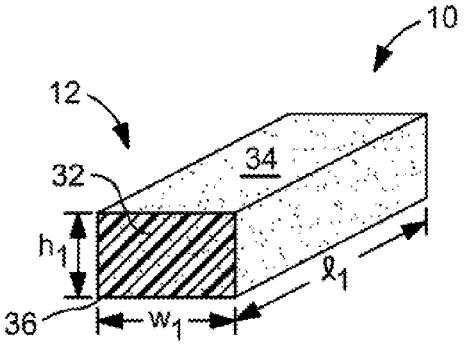
FIG. 4 is a perspective view of a foam-based footer product.

Referring now to FIG. 4, a footer product 10 is formed of only a single insulating member 12, or of an aggregation of elements so bonded to each other as to effectively form a single insulating member 12. Insulating member 12 has an interior 32, an upper surface 34, and a lower surface 36. The interior of the insulating member extends generally from upper surface 34 to lower surface 36. Upper surface 34 has the capacity to receive a load, such as the weight of external wall 14 of the building. The load carrying capacity of the upper portions of insulating member 12 at and adjacent upper surface 34 of footer product 10 must be great enough that the upper portion, including the upper surface, of the insulating member, can accept the load applied by the overlying building structure, including spot loads, point loads, linearly-extending loads, etc., without catastrophic failure of the footer product, and without unacceptable levels of deformation/strain in the footer product. Such load is typically applied over a relatively smaller cross-sectional area of the footer product at upper surface 34 than the area over which the load is applied to the underlying natural soil or rock at lower surface 36. Interior 32 of insulating member 12 has the capacity to transfer the load from upper surface 34 to lower surface 36 and has the ability to distribute that load laterally as well as to transfer the load vertically such that the load is applied and/or distributed relatively evenly or uniformly along the length and width of the footer product at the lower surface of the footer product. Desirably, interior 32 of the insulating member can laterally disperse the load about the general area of the lower surface of the footer product which underlies a given area of the load applied at the upper surface of the footer product. Thus, one function of the footer product is to laterally and longitudinally disperse the load applied at the top surface of the footer product in the process of transferring that load force from the top surface of the footer product to the bottom surface of the footer product. Lower surface 36 of the footer product has the capacity to transfer the load, generally as received, to the underlying soil.

Still referring specifically to FIG. 4, footer product 10 has a height "$h_1$", a width "$w_1$" and a length "$l_1$". Height "$h_1$" must have a magnitude of at least 4 inches. For a residential building, such as a typical house of from about 1,500 to 2,400 square feet, height "$h_1$" of footer product 10 is about 4 inches to about 20 inches, optionally about 5 inches to about 18 inches, optionally about 6 inches to about 10 inches. Most desirably, height "$h_1$" of footer product 10 for a typical house is about 8 inches. For a commercial or industrial building, height "$h_1$" of footer product 10 can be much greater depending on the load to be applied to the footer product.

Width "$w_1$" of footer product 10 for a typical house is about 4 inches to about 30 inches. Desirably, width "$w_1$" of footer product 10 for a typical house is about 12 inches to about 24 inches. More desirably, width "$w_1$" of footer product 10 for a typical house is about 14 inches to about 22 inches. Even more desirably, width "$w_1$" of footer product 10 for a typical house in the US is about 16 inches to about 20 inches. Most desirably, width "$w_1$" of footer product 10 for a typical US house is about 16 inches. For a commercial or industrial building, width "$w_1$" of footer product 10 can be much greater depending on the load to be applied to the footer product.

Length "$l_1$" of a footer product 10 for a typical house is about 10 feet to about 100 feet. Desirably, length "$l_1$" of a footer product 10 for a typical house is about 20 feet to about 60 feet. More desirably, length "$l_1$" of a footer product 10 for a typical house is about 20 feet to about 40 feet.

An important factor of materials selection for insulating member 12 is load bearing capacity of the material, which is sometimes expressed as "compressive strength" capacity. The load bearing capacity of footer product 10 can be constant throughout the top-to-bottom height of footer product 10 or the load bearing capacity can vary. Desirably, the load bearing capacity is constant throughout the top-to-bottom cross-section of the insulating member. As a general statement, the load bearing capacity of the insulating member material, along with the strain/deflection capacity, must be great enough to support the anticipated overlying building loads. Where the footer is engineered to apply maximum allowable downward force on the underlying soil, up to the maximum load capacity of the soil, then the load bearing capacity of the insulating member material is at least as great as the load bearing capacity of the soil. Thus, where the load bearing capacity of the soil is e.g. 3000 pounds per square foot (psf), selecting an insulating member material having a load bearing capacity of at least 3000 psf at the bottom of the footer is required.

As used herein, "load bearing capacity" of the footer or footer product is that load which the footer can support, spread evenly over the top of the footer, while satisfying the acceptable strain deformation of the footer which can be tolerated by the structure to be constructed on the footer, including satisfying all applicable building codes.

Where the overlying building load will be substantially less than the load bearing capacity of the soil, then the load bearing capacity of the insulating member material can be reduced accordingly. Thus, where building load is calculated to be e.g. 1000 psf, then the specified load bearing capacity of the e.g. foam can be reduced accordingly to at least, but not necessarily more than, about 1000 psf.

The footer product 10 containing insulating member 12 also functions as a thermal shock barrier. At northern latitudes, the temperature at basement depth of about 8 to 9 feet is relatively constant at about 50-55 degrees F. As used herein, "thermal shock barrier" means a barrier to transfer of cold, from the soil underlying the footer, into the building. Insulating member 12 is an effective thermal insulator and can limit or greatly attenuate the transmission/conductance of heat or cold. Because of this feature, footer product 10 functions as part of the barrier to transfer of the colder temperature of the soil, underlying the footer, into the building. Depending on the specific construct of the footer product, including the density of the e.g. foam, footer product 10 can provide an overall thermal insulation value of e.g. R4 to R20, or more, and any and all intervening values. Restated, the thermal shock barrier feature of the footer functions as part of the barrier against transfer of heat, from e.g. a heated space inside the building, through the footer, out of the building and to the soil underlying the footer.

Still referring to FIG. 4, and in addition to having a functionally satisfactory level of load bearing capacity, insulating member 12 has to be stiff enough, and rigid enough, to spread the load/force, received from the building, substantially evenly, uniformly over the area of underlying soil 20 and must have sufficient compressive strength/resistance to maintain such a necessary dimensional constancy that building stability/integrity is not compromised or threatened. The stiffness and rigidity, as well as the compressive strength, of insulating member 12 can be constant or can vary between upper surface 34 and lower surface 36.

Desirably, the load applied to insulating member 12 at upper surface 34 should be evenly or uniformly distributed across the width "$w_1$" of footer product 10 at lower surface 38. At a minimum, the load exerted on underlying soil 20, at any part of the footer product area, cannot exceed the load bearing capacity of the underlying soil 20. Therefore, point loads delivered by the footer to the underlying soil are not acceptable to the extent such point load, when translated through the footer interior to lower surface 36 of the footer, exceeds the load bearing capacity of the underlying soil 20.

Where the entire mass of a footer product 10 all has the same physical properties, especially density and/or hardness, as in the embodiments represented by FIG. 4, material density is relatively greater than the minimum density which can be used where other layers are added to e.g. a such foam layer. Thus, a density for e.g. an expanded polystyrene foam, used alone as a single layer or a single aggregated layer, for use under a building which will apply a relatively lighter load such as 1000 psf, is at least 10 pcf and the footer will have a height of at least 4 inches. Where such footer is designed to support a relatively heavier load such as 2000-2500 psf, foam density for such expanded polystyrene foam footer is at least 10 pcf, typically 15 pcf to 40 pcf, or more, optionally 20 pcf to 30 pcf, or 25 pcf, depending on the magnitude of the load and any contemplated point loads.

Where additional layers are joined to foam layer 12 at the upper and/or lower surfaces 34, 36, the density of foam layer 12 can be less, e.g. as low as 2 pcf, and the overall height of the footer product can be less, e.g. as low as 2 inches. In addition, where insulating member 12 is relatively dense, e.g. unfoamed or only lightly foamed, the rigidity of the material may be such as to perform satisfactorily in terms of load distribution and load transfer with height as small as 2 inches; however, the thermal requirement of at least R4 must also be met.

Figure 5:
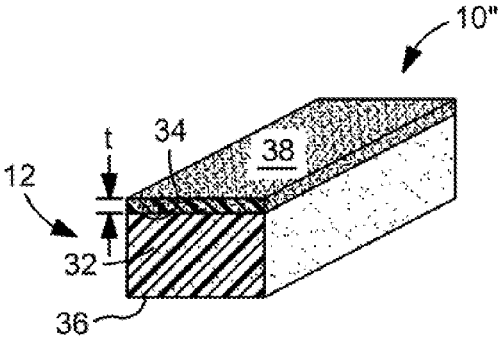
FIG. 5 is a perspective view of a second embodiment of a foam-based footer product of the invention having a load bearing member at its upper surface.

Referring now to FIG. 5, a second embodiment of a footer 10", is depicted. In this embodiment, a top load distributing member 38 is positioned over and secured to upper surface 34 of a foam insulating member 12. Load distributing member 38 can be secured to upper surface 34 of foam member 12 in a variety of ways. One way to secure load distributing member 38 to upper surface 34 of foam member 12 is by lamination. As used herein, "lamination" means to unite two or more layers together. Alternatively, load distributing member 38 can be secured to upper surface 34 of the foam member 12 by various means well known by those skilled in the art, including but not limited to, use of adhesive, glue, cohesive, compression, heat and pressure, thermal bonding, chemical bonding, mechanical bonding, driving FRP needles through the footer product, top-to-bottom, etc. Such reinforcements can be made of e.g. metal such as steel, aluminum, titanium, stainless steel, or from polymeric or fiber-reinforced polymeric materials. Such reinforcements are sufficiently thick in cross-section to provide a desired level of end-to-end compression resistance, so as to sufficiently reinforce the load-bearing capacity of the e.g. foam block in order to meet the required load-bearing demands of the structure which will bear down on the respective footer element.

Load distributing member 38 can be formed from various materials. For example, load distributing member 38 can employ materials such as dura-rock, green board, composite board, fiber board, concrete board, recycled plastic, crushed glass, etc. Load distributing member 38 should be both stiffer and more rigid than foam insulating member 12, and thus capable of, to at least some enhanced degree, laterally distributing and/or transferring the load applied at the upper surface of footer product 10" and transferring that distributed load to the interior 32 of the foam insulating member 12, whereby such distributed load is received at lower surface 36 of foam insulating member 12.

Load distributing member 38 can be a polymeric foam which has greater bending rigidity, for an equivalent width and thickness, than foam insulating member 12. For example and without limitation, where foam insulating member 12 is 2 pcf extruded polystyrene foam, load distribution member 38 can be 15 pcf, or 20 pcf, of 25 pcf, extruded polystyrene foam.

Top load distributing member 38 has a thickness "t". Generally, thickness "t" is at least 0.25 inch. More desirably, thickness "t" is at least 0.5 inch. Even more desirably, thickness "t" is at least 1 inch. More desirably, thickness "t" is about 1 inch. The actual thickness "t" of load distributing member 38 will vary depending upon the composition of load distributing member 38 and the magnitude and lateral distribution profile of the downwardly-directed force anticipated to be imposed on load-bearing member 38 as well as the ability of other members of the footer product to laterally distribute the load. Thus, the selection of each member/layer of footer product 10 is made as part of an overall assessment of the load bearing and distributing capabilities of all other members/layers of the respective footer product, and how those capabilities will interact with each other and with the load, in the resulting footer product.

Figure 6:
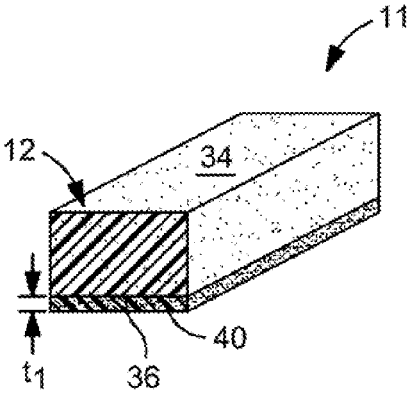
FIG. 6 is a perspective view of a third embodiment of a foam-based footer product of the invention having a load bearing member at its lower surface.

Referring to FIG. 6, a third embodiment of a footer product 11, is depicted. In this embodiment, a bottom load bearing, load distributing, load transferring, member 40 is positioned under and secured to lower surface 36 of foam insulating member 12. Load distributing member 40 can be secured to lower surface 36 of foam insulating member 12 in a variety of ways. One way to secure second load bearing member 40 to lower surface 36 of foam insulating member 12 is by lamination. Alternatively, load bearing member 40 can be secured to lower surface 36 of foam insulating member 12 by various means well known by those skilled in the art, including but not limited to: use of adhesive, glue, cohesive, compression, heat and pressure, thermal bonding, chemical bonding, mechanical bonding, driving FRP needles, rods, pins, or rivets through the footer product, top to bottom, during fabrication of the footer product, etc.

Load distributing member 40 can be formed from various materials. For example, load distributing member 40 can employ such materials as dura-rock, green board, composite board, fiber board, concrete board, recycled plastic, crushed glass, etc. Load distributing member 40 should be both stiffer and more rigid than foam insulating member 12, and thus capable of, to at least some enhanced degree, laterally and longitudinally distributing and/or transferring the load applied to member 40 by interior 32 of foam insulating member 12, whereby such distributed load is received at underlying soil 20. Bottom load distributing member 40 can be identical to top load distributing member 38. Alternatively, bottom load distributing member 40 can be different from top load distributing member 38 in composition, thickness, structure, shape, size, etc.

Load distributing member 40 can be a polymeric foam which has greater bending rigidity, for an equivalent width and thickness, than foam insulating member 12. For example and without limitation, where foam insulating member 12 is 2 pcf extruded polystyrene foam, load distribution member 40 can be 15 pcf, or 20 pcf, of 25 pcf, extruded polystyrene foam.

Load distributing member 40 has a thickness "$t_1$". Generally, thickness "$t_1$" is at least 0.25 inch. More desirably, thickness "$t_1$" is at least 0.5 inch. Even more desirably, thickness "$t_1$" is at least 1 inch. More desirably, thickness "$t_1$" is about 1 inch. The actual thickness "$t_1$" of load distributing member 40 will vary depending upon the composition of load distributing member 40 and the magnitude and lateral distribution profile of the downwardly-directed force anticipated to be imposed on load distributing member 40.

Figure 7:
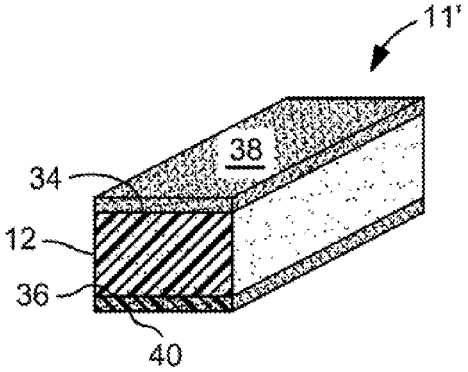
FIG. 7 is a perspective view of a fourth embodiment of a foam-based footer product of the invention having a first load bearing member at its upper surface and a second load bearing member at its lower surface.

Referring now to FIG. 7, a fourth embodiment of a footer product 11', is depicted. In this embodiment, a top load distributing member 38 is positioned over, and secured to, upper surface 34 of foam insulating member 12 and a bottom load distributing member 40 is positioned under and secured to lower surface 36 of foam insulating member 12. Top and bottom load distributing members 38 and 40, respectively, can be secured to the respective surfaces 34 and 36 of foam insulating member 12 as explained above. The composition, construction, shape, density, rigidity, and/or size of load distributing members 38 and 40, respectively, can be identical to each other or can vary. The materials from which the top and bottom load distributing members 38 and 40, respectively, are formed, and the respective physical properties, can be those taught and described above. The function of each of load distributing members 38 and 40, respectively, is as was explained above. Again, bottom load distributing member 40 can be identical to top load distributing member 38. Alternatively, bottom load distributing member 40 can be different from top load distributing member 38 in composition, thickness, structure, shape, and/or size, etc. The use of both top and bottom load distributing members 38 and 40 provides an increase in the load bearing capacity and/or load distribution capacity of such footer product 11'.

In the embodiments represented in FIGS. 5, 6, and 7, the length "$l_1$", width "$w_t$", and height "$h_1$" dimension ranges are the same as those stated for the embodiment represented in FIG. 4, except that the range for height "$h_1$" is expanded to about 2 inches to about 20 inches for all structures of FIGS. 5, 6, and 7.

Referring now to FIGS. 8-12, a fifth embodiment of a footer product 42 is shown which includes a plurality of foam members 44. Footer product 42 has overall length "$l_2$", width "$w_2$" and height "$h_2$". A footer product 42 has a length "$l_2$" of about 2 feet to about 60 feet. In many instances, length "$l_2$" is equal to or less than about 40 feet. Alternatively, length "$l_2$" is equal to or less than about 30 feet. In some instances, length "$l_2$" is equal to or less than about 25 feet, optionally equal to or less than about 20 feet.

Width "$w_2$" is about 12 inches to about 48 inches. Optionally, width "$w_2$" is about 14 inches to about 40 inches, optionally about 16 inches to about 36 inches, optionally about 18 inches to about 24 inches. Typically, width "$w_2$" is about 18 inches.

Height "$h_2$" is usually about 2 inches to about 12 inches. Optionally, height "$h_2$" is about 2 inches to about 10 inches, optionally about 2 inches to about 8 inches, optionally about 2 inches to about 4 inches. Typically, height "$h_2$" is about 3 inches.

Figure 9:
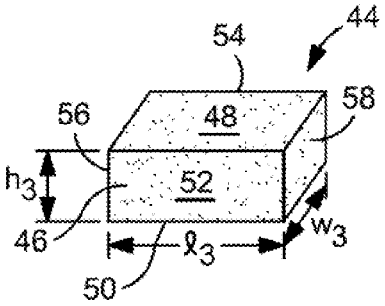
FIG. 9 is a perspective view of a foam element incorporated into the footer product shown in FIG. 8.

FIG. 9 shows a single, three-dimensional rectangular insulating member 44, which may be a foam member. In footer product 42, a plurality of insulating members 44 are utilized. Each insulating member 44 can be formed from any of a number of available compositions as recited above for insulating member 12. A polyisocyanurate foam works well in this embodiment. In light of the teaching herein, those skilled in the art may now become aware of other materials which can also be utilized in footer product 42.

Desirably, insulating member 44 is a dosed cell foam. Each of insulating members 44 can have a lower load bearing capacity than foam insulating member 12 taught above with reference to footers 10, 10", 11, and 11' because, in this embodiment, the plurality of foam insulating members 44 will ultimately be encased, covered or enclosed, or effectively covered or enclosed, by one or more layers of a load-bearing, resin-impregnated, fiber-reinforced polymeric (FRP) material. As used herein, "fiber reinforced polymeric (FRP) material" means a fibrous material wherein reaction-curing resin has been used to fill substantially all voids in a fibrous carrier layer such as a woven roving, a fine netting, a porous sheet, a ribbon, a band, or some other fibrous structure, thus fully encasing the fibrous substrate. As used herein, "woven roving" means an elongate fiber bundle where the fibers have been formed into a slightly twisted fiber bundle. Such fiber-reinforced polymeric (FRP) material can contain one or more different kinds of fibers which have been impregnated with polymer resin to form strong, rigid and hard layers or intercostals.

The fiber materials used to construct footer 42 can be selected from a wide variety of conventionally available fiber products. Glass fibers are one of the most cost effective materials. Other fibers which are contemplated as being acceptable include, without limitation, carbon fibers, Kevlar® fibers, basalt fibers, and metal fibers, such as copper and aluminum. The fibers can vary in size, dimension and configuration. Furthermore, the fibers can be nano-size fibers, if desired. Still other fibers can be selected to the extent of their reinforcing properties, as well as other properties required to satisfy the structural demands of the building industry and/or the particular construction project.

The lengths, widths and cross-sectional shapes of the fibers used in the footer product can be selected according to the demands of the footer product 42 and the loads which footer product 42 is expected to bear. A given fiber material can include multiple individual, identifiable fibrous layers which, permissively, may be attached to, or not attached to, each other. For example, various layers can be attached to one another by stitching, by fiber entanglement, or by other means known to those skilled in the art.

The polymer used to impregnate and/or carry the fibers can be selected from a wide variety of conventionally available multiple-part reaction-curing resin compositions. Typical resin is a two part liquid where two liquid parts are mixed together before the resin is applied to the fiber substrate. Third and additional components, including conventionally-known additive packages, can also be used in the reaction mixture, as desired, in order to achieve a predetermined set of properties in the cured resin. The resin mixture should be of sufficiently liquidity to be readily dispersed throughout the fibers thereby filling all voids in the fiber material. Examples of useful reaction curing resins include, but are not limited to: epoxy resins, vinyl ester resins, polyester resins, acrylic resins, polyurethane resins, phenolic resins, and polymers known as eco-resins.

For example and without limitation, suitable resins for selection are acrylic resins, polyester resins, and vinyl ester resins. Other resins can be selected so long as the resin does not react with the composition in foam members 44 or 62 to thereby degrade the properties or performance of either the foam or the resin, or react with any of the compositions of the underlying soil 20 or the overlying wall 14.

Figure 8:
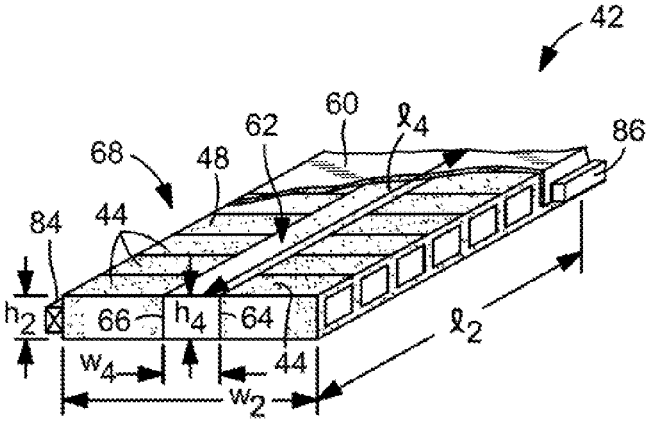
FIG. 8 is a cut away, perspective view of a fifth footer product of the invention.

Still referring to FIGS. 8 and 9, each insulating member 44 is a single, integral member such as a foam board, a foam block, a foam core, etc. A footer product 42 formed from one of the above recited materials is relatively easy to cut to length or other dimension at the work site to accommodate a specific length and/or width trench 16. In footer product 42, each of foam insulating members 44 can be surrounded or enclosed in a fiber-reinforced polymeric (FRP) material and each can be cut using a manual saw, a circular saw, a skill saw, a ring saw, or some other kind of cutting tool. In light of the teaching herein, those skilled in the foam art and/or the fiberglass or other materials arts may now become aware of other methods which can be used to cut or shape a particular footer product 42.

As mentioned above with reference to foam insulating member 12, the plurality of foam insulating members 44 is normally moisture resistant, and desirably, each is moisture proof. However, it is possible to treat each of foam insulating members 44, using chemicals or other additives to make each resistant to degradation due to contact with any acidic or basic composition which may be present in the soil. Furthermore, each of foam insulating members 44 can be treated to limit or prevent degradation resulting from contact with a foreign substance which may have permeated ground 18, for example, oil, gasoline, methane gas, other gases, various kinds of chemical waste, etc.

Referring back to FIG. 8, footer product 42 should have a load bearing capacity which (i) at the location where a load is applied to the upper surface of the footer, is equal to or greater than the load, namely any concentrated point load, which is applied by the overlying building wall, and wherein the overlying building load, which is applied to the soil at the lower surface of the footer, cannot exceed the load bearing capacity of the soil 20 located directly under footer product 42 when the footer product is positioned in a trench 16, or (ii) is equal to or greater than the load applied by the overlying building.

Such characteristics assure that footer product 42 can apply the overlying load over a sufficiently large area of the underlying soil that the underlying soil can bear the load without moving or shifting. One does not want footer product 42 to move or shift once the footer product is positioned in trench 16 and a load bearing wall 14, formed thereon, exerts a downward or angular force against such footer product.

As mentioned above with reference to footer product 10, each of the plurality of foam insulating members 44 has excellent insulation properties. Because of this, footer product 42 can also function as a thermal shock barrier when positioned in a trench 16. As with footer member 10, foam insulating members 44 can limit or prevent heat or cold from passing through footer product 42. Because of this thermal insulating property, footer product 42 can help prevent conduction of heat out of the building or, in the alternative, conduction of cold into the building. By helping to maintain a constant temperature in the building, an average efficiency increment can be achieved for the building.

Referring again to FIG. 9, each of the plurality of foam insulating members 44 has an upper surface 48, a lower surface 50, an interior 46 between the upper and lower surfaces, a pair of side surfaces 52 and 54, and a pair of ends 56 and 58. Sides 52 and 54 are aligned opposite one another. Likewise, ends 56 and 58 are aligned opposite one another. Each of foam insulating members 44 is essentially a 3-dimensional foam block. Desirably, each of foam insulating members 44 is a three-dimensional rectangular structure. However, a cubic structure can also be used as well as other geometrical designs and configurations, if desired. For purpose of discussion only, and without limitation, each of foam insulating members 44 has a height "$h_3$" of about 3 inches, a width "$w_3$" of about 4 inches, and a length "$l_3$" of about 7 inches.

Figure 10:
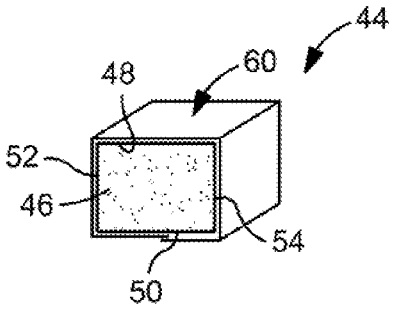
FIG. 10 is a perspective view of a foam element as in FIG. 9, surrounded on four sides by a layer of reinforcing fibrous material.
Figure 11:
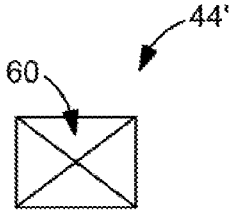
FIG. 11 is an end view of a footer product element, including a foam element as in FIG. 9, completely enclosed by a resin impregnated, fiber reinforced polymeric (FRP) material.

Referring now to FIGS. 10 and 11, an elongated ribbon or band, e.g. a layer 60, of fibrous material, is wrapped around upper and lower surfaces 48 and 50, respectively, as well as around side surfaces 52 and 54 of foam insulating member 44. Alternatively, foam insulating member 44 can be entirely enclosed by layer 60 of fibrous material as illustrated in FIG. 11.

Layer 60 of fibrous material is ultimately impregnated with a polymeric resin and is subjected to a reaction-curing process wherein the resin is cured. This action creates a strong, rigid and hard casing around each of foam insulating members 44. Where an entire foam insulating member 44 is enclosed with a cured resin-impregnated, fiber-reinforced polymeric (FRP) material as in FIG. 11, the resulting structure will be stronger than if only four surfaces of the foam insulating member block are surrounded or wrapped in the same resin impregnated, fiber-reinforced polymeric (FRP) material as in FIG. 10.

Returning again to FIG. 8, footer product 42 also includes a first wrapped foam insulating member 62. First foam insulating member 62 is constructed in an identical fashion as the remaining foam insulating members 44. Namely, foam insulating member 62 is covered, wrapped or otherwise enclosed in one or more layers 60 of fibrous material. In FIG. 8, first foam insulating member 62 is shown as being entirely enclosed in resin impregnated, fiber-reinforced polymeric (FRP) material 60. First foam insulating member 62 has a first side 64 and an oppositely aligned second side 66.

First foam insulating member 62 is aligned along length "$l_2$" of footer product 42 and is located approximately in the center of footer product 42. First foam insulating member 62 functions as the central, longitudinal support for footer product 42. In this capacity, first foam insulating member 62 adds strength, rigidity and stability to footer product 42 in the longitudinal direction. First foam insulating member 62 has a height "$h_4$", a width "$w_4$" and a length "$l_4$". For purposes of discussion only, and without limitation, first foam insulating member 62 has a height "$h_4$" of about 3 inches, a width "$w_4$" of about 4 inches, and a length "$l_4$" which can range from about 2 feet to about 60 feet or longer. Optionally, length "$l_4$" of the first foam insulating member 62 is about 4 feet to about 40 feet, optionally about 6 feet to about 30 feet, optionally about 8 feet to about 25 feet. Typically, length "$l_4$" of first foam insulating member 62 is equal to or less than about 20 feet.

In construction of footer product 42, first foam insulating member 62 is an elongate member which extends approximately the entire length "$l_2$" of the footer product.

Still referring to FIG. 8, half of the remaining foam insulating members 44 are aligned side by side to one another. This side-by-side arrangement, alignment, is a contact relationship which means that a foam insulating member 44 physically contacts and abuts an adjacent foam insulating member 44. No large air spaces, voids or gaps are present between adjacent foam insulating members 44. An end of each of foam insulating members 44 contacts first side 64 of first foam insulating member 62.

The other half of the remaining foam insulating members 44 are aligned side by side to one another, as recited above, and each has an end which contacts second side 66 of first foam insulating member 62. This arrangement creates a structure 68 which provides strength, support and rigidity in the horizontal direction, which generally extends along width "$w_2$".

The number of foam insulating members 44 situated on each side 64 and 66 of first foam insulating member 62 can vary. For given dimensions of foam insulating members 44 along the direction of length "$l_2$", the more foam insulating members 44 that are present, the longer will be the length "$l_2$" of footer product 42. The number of foam insulating members 44 located on one side of first foam insulating member 62 may be identical in number to the number of foam insulating members 44 situated on the opposite side of first foam insulating member 62. It does not matter if an even or an odd number of foam insulating members 44 are utilized on each side of first foam insulating member 62. Nor does it matter if the number of foam insulating members on one side of the first foam member is different from the number of foam insulating members on the opposing side of the first foam insulating member. Further, foam insulating member 62 can be, or can be replaced by, multiple foam insulating members having a common height and width, and abutting end to end and collectively extending along the full length of the footer product.

Structure 68, shown in FIG. 8, can be modified or changed such that each foam insulating member is an uprightly-extending honeycomb structure or some other structure, as desired. In any event, the resulting structure has a reinforcing upright FRP intercostal at each of the upstanding foam walls which is accompanied by a resin-impregnated fiber reinforcing layer, thus at every abutment of adjacent surfaces of wrapped foam members 44 and 62.

Foam insulating members 44 can be so designed and configured as to provide any desired pattern of uprightly-oriented intercostals extending from the top of the footer product to the bottom of the footer product.

Figure 12:
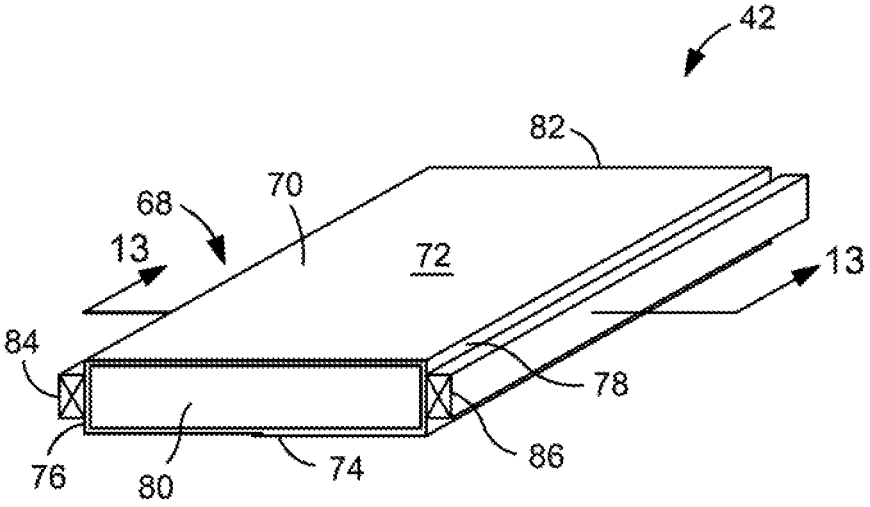
FIG. 12 is a perspective view of the footer product shown in FIG. 8, surrounded on four sides by resin impregnated, fiber reinforced polymeric (FRP) material and having a pair of longitudinal support members.

Referring now to FIG. 12, an outer covering 70 of fibrous material is wrapped around and entirely encloses the overall footer product structure 68. Alternatively, outer covering 70 can only partially enclose or surround the overall footer product structure 68, if desired. The entire assembly of foam insulating members 44 and 62, each wrapped on the appropriate surfaces in appropriate one or more layers of fibrous material, as well as outer covering 70, is subjected to a process, such as vacuum infusion, a wet lay-up, or some other process which applies an appropriate quantity and distribution of reaction-curable resin about the assembly, in a suitable mold, and cures the resin. "Wet lay-up" means that surfaces which are to receive resin are wetted with resin by the time the mold is closed. Those skilled in the art of curing polymer resins know the steps involved, including the time and temperature conditions, etc. The cured, resin-impregnated, fiber-reinforced polymeric (FRP) footer product has an upper wall 72, a lower wall 74, a pair of side walls 76 and 78 and a pair of end walls 80 and 82, collectively enclosing foam insulating members 44 and 62.

Upper wall 72, acting as an upper load bearing member, has the capacity for receiving a load from an overlying external wall 14 which extends upwardly from upper wall 72 of the resulting cured footer product 42. The combination of the plurality of foam insulating members 44 and first foam insulating member 62, along with the respective side walls 76 and 78, and the pair of end walls 80 and 82, have the capacity to transfer the load from upper wall 72 to lower wall 74, which acts as a lower load bearing member, and to cause the load to be substantially evenly or uniformly distributed, laterally and longitudinally, such that the load reaching lower wall 74 is, laterally and longitudinally, substantially uniformly distributed. The above-mentioned intercostals, depending on their physical properties, quantity and distribution, can play a substantial role in such load distribution. Desirably, the load is uniformly distributed laterally and longitudinally as the load is transferred downward to lower wall 74 so that no substantial point loads or spot loads are present at lower wall 74. Lower wall 74 also has the capacity for further laterally and longitudinally distributing the load, namely for fine-tuning the load distribution, and for transferring the so-distributive load to underlying soil 20 without exceeding the load bearing capacity of the soil at any one location.

Still referring to FIG. 12, a pair of longitudinal support members 84 and 86 is secured to opposite side walls 76 and 78. Use of longitudinal support members 84 and 86 is optional. However, the presence of the pair of longitudinal support members 84 and 86 can be advantageous. Each of longitudinal support members 84 and 86 can be an elongate wood 2 by 4 which is secured to footer product structure 68. For example, the pair of longitudinal support members 84 and 86 can be secured to footer product structure 68 by using of adhesive, glue, mechanical fasteners such as screws, chemical bonds, etc.

Longitudinal support members 84 and 86 can be made from different materials such as metal 2 by 4's. The overall geometric shapes or configurations of longitudinal support members 84 and 86 can vary. The main function of longitudinal support members 84 and 86 is to add strength, rigidity and stability to footer product 42.

Two additional features which may be attributed to support members 84, 86 may be as follows. First, support members 84, 86 may extend beyond a longitudinal end of footer member structure 68 whereby securing members such as screws can be driven into the sides of the next adjacent footer member structure adjacent an end of footer product 42, thus to secure adjacent footer products to each other end-to-end.

Second, vertical anchor supports (not shown) can be driven into the underlying soil and then e.g. screwed to support members 84, 86, thus to provide lateral stability from the underlying soil to footer product 42 until such time as the overlying building is built and the building load is bearing down on the footer product.

Figure 13:
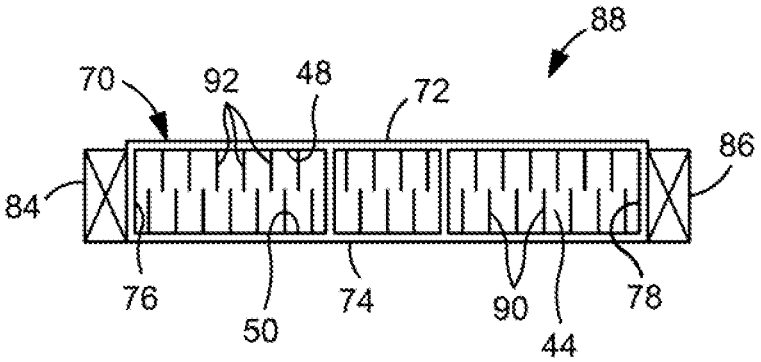
FIG. 13 is a cross-sectional view of the footer product shown in FIG. 12 depicting a plurality of vertical support members inside the footer product.

Referring now to FIG. 13, still another embodiment of a footer product 88 is depicted. Footer product 88 is similar to footer product 42 except that a plurality of vertical support members 90 extend upward from lower surface 50 of foam insulating members 44 and 62 to about half the height of the footer product, and a plurality of vertical support members 92 extend downward from upper surface 48 of foam insulating members 44 and 62 to about half the height of the footer product. The exact dimensions and configurations, particularly height and thickness, of vertical support members 90 and 92 can vary, less or greater than illustrated, as well as the material from which each is constructed. For example, vertical support members 90 and 92 can be made from metal, steel, aluminum, plastic, thermoplastic, from an FRP composite material, or can be made from some other material known to those skilled in the art. Vertical support members 90 and 92 increase the strength and rigidity of footer product 88 and assist the footer in retaining its lateral, longitudinal, and upright configuration and positioning. Such additional vertical support members 90 and 92 can also facilitate the even and uniform distribution of any load applied to footer product 88, such that such loads are more evenly and uniformly distributed to the underlying soil.

Such support member 90 or 92 can extend a portion of the height of the footer member, or all of the height of the footer member. Such support member can extend only from the top layer, only from the bottom layer, or from the top layer and from the bottom layer as shown. Such upstanding support members can extend, for example and without limitation, in straight lines in a single lateral or longitudinal direction, in straight lines in changing directions, in a zigzag pattern, in crossing lines in two or more directions, in a honeycomb pattern, or in any other pattern which provides the desired level of support to the upper and lower layers of the respective footer member. There is also a trade-off between the strength built into the upper and lower layers, and the strength built into support members 90 or 92. Given the teaching herein regarding the capacity to use FRP products as footer products, those skilled in the art can now engineer such footer products having a wide array of specifications to meet the requirements of any particular building project.

In another embodiment, not shown, incremental load bearing capacity can be selectively built into the foam-based footer product, whether or not using any other fiber or FRP elements, by inserting FRP pins, rods, needles, or rivets into the foam block. Such reinforcing elements extend from the top of the foam block to the bottom of the foam block, typically perpendicular to the top and the bottom of the foam block. The number of e.g. pins, the uniformity of pin distribution, the pin pattern, are all elements of the engineering design of the footer, driven by the particular load distribution expected to be imposed on the respective footer. The pin pattern can be more, or less, concentrated along the length of the footer product in order to tailor a particular portion of the length of the footer product to expected variations in the load expected to be imposed on the footer product along the length of the anticipated overlying wall.

Such pin pattern plays a similar role to the intercostals illustrated in FIGS. 8 and 13, but with perhaps greater versatility in design of the upstanding reinforcement pattern so created. Exemplary such foam blocks containing such pins/rods are available from Creative Pultrusions Inc., Alum Bank, Pa.

As a first part of the engineering task, the designer will determine whether the footer structure should include fiber, and if so, will select the type of fiber, the FRP construct, and the quantity of fiber.

As a second part of the engineering task, the designer will select the resin products which will be used to infuse and fill the fiber product. The resin and fiber are selected for their collective and cooperative functionalities as the fiber and resin work together to develop much of the strength of the footer product, especially through use of the intercostals in the embodiment illustrated in e.g. FIGS. 8 and 12.

Vinyl ester, acrylic, and polyester resins have been mentioned above and are desirable resins for use in the invention. Fiberglass is a preferred fiber based on the current combination of strength, and cost of material. The quantity of fiber used, and the space occupied by the fiber, generally dictate the quantity of resin needed in a given construct, because the resin is applied until no more air can be displaced from the resin. Accordingly, the construct of the fiber, and the density per unit of volume of the fiber, in large part, determines the quantity of resin used.

The fiberglass is a fabricated product in sheet form, typically obtained in rolls of such sheet fiberglass. Such sheet may be woven, stitched, rovings, batt material, or the like, depending on the function desired for the given layer. The fiberglass sheets can be applied to, wrapped around, the foam insulating members in a single layer, or in multiple layers.

Depending on the strength required by the footer, such as for a very light duty building versus a building which imposes a much heavier load on the footer, the fiberglass sheet used for wrapping foam insulating members 44 and 62, whether a single layer or multiple layers, amounts in total to about 10 ounces per square yard of coverage on the foam insulating member to about 150 ounces per square yard, optionally about 20 ounces per square yard to about 100 ounces per square yard of coverage on the foam insulating member, optionally about 50 ounces per square yard to about 90 ounces per square yard, optionally about 65 to about 80 ounces per square yard, optionally about 70-75 ounces per square yard. For example, in a relatively lighter-duty footer, the fiberglass is about 15 ounces per square yard to about 22 ounces per square yard woven roving. In a more robust footer, designed for relatively heavier-duty loads, the fiberglass is about 70 to about 80 ounces per square yard woven roving. For example, foam insulating members 44 and 62 can be wrapped with 15 to 22 ounces of fiberglass 50/50 woven roving where 50 percent of the fibers extend in a warp direction and 50 percent of the fibers extend in a weft direction, lapped 6 inches at the top center of the given foam insulating member.

In some instances chopped strand matter is appropriate. In some instances, light-weight layers of fiberglass, such as ½ ounce per square foot veil, may be used to facilitate resin flow. Those skilled in the art of fiber-reinforced polymeric products can now engineer the desired product properties in light of the disclosure herein that FRP products are suitable for use as load-bearing footers in otherwise-conventional buildings.

The designer also considers the relative quantity of fiber used in the outer wrapping layer 70 versus the quantity of fiber used in wrapping the individual foam insulating members 44, 62. In some embodiments, the same fiber is used in both places. In some embodiments, a relatively heavier fiber product is used in the outer skin defined by outer layer 70; and a relatively lighter fiber product is used in wrapping the individual foam insulating members. In other embodiments, a relatively heavier fiber product is used in wrapping the individual foam members, and a relatively lighter fiber product is used as a wrapping in outer layer 70. In some embodiments, the same weight of fiber, in terms of ounces per square yard, is used in wrapping foam insulating members 44 and foam insulating member 62. In other embodiments different weights of fiberglass are used in each of foam member 44 and foam member 62.

In any event, the footer is designed according to local code to bear the anticipated load, while incurring an acceptable project cost associated with cost of materials for the footer, cost of assembly of the footer, and cost of emplacing the footer and erecting an overlying wall on top of the footer.

Method

A method of forming footer product 42 includes the steps of manufacturing a plurality of e.g. foam insulating members 44 surrounded or enclosed in one or more layers of fibrous material 60. The foam insulating members 44 are manufactured to a predetermined size, each having a height "$h_3$", a width "$w_3$" and a length "$l_3$". In addition, an elongate first foam insulating member 62 is manufactured to specified length "$l_4$", height "$h_4$" and width "$w_4$". Elongate first foam insulating member 62 also includes a covering or jacket of one or more layers of fibrous material 60. An initial charge of liquid resin is placed in the bottom of a suitable mold.

A central portion of a layer 70 of fibrous material is placed into the mold on the resin. Then additional resin is added to the mold on top of the central portion of layer 70. A fiber-wrapped foam insulating member 62 is first wetted with resin on two vertically-oriented sides and then is placed into the mold. Wrapped foam insulating members 44 are then wetted with resin on two vertically-oriented sides and positioned adjacent, and are abutted against, first side 64 of elongate first foam insulating member 62 in the mold. Additional foam insulating members 44 are wetted and positioned adjacent, and are abutted against, second side 66 of elongate first foam insulating member 62 in the mold. Foam insulating members 44 can be placed on respective sides of foam insulating member 62 in any desired sequence. The exact number of foam insulating members 44 utilized is determined by their width "$w_3$" and the overall required length "$l_2$" of footer member 42. This arrangement ultimately creates footer product structure 68. Additional resin is then placed in the mold, on top of foam insulating members 44 and 62.

The outlying portions of fibrous layer 70 are then drawn up about, collectively, the remote surfaces of foam insulating members 44 and elongate foam insulating member 62, and thence over, and down onto, the tops of the respective foam insulating members 44 and 62. Yet more resin is added to the mold, on top of each of the outlying portions of layer 70. The mold is then closed. The resin fills all the spaces in the fiber layers and outside the foam insulating members, thus eliminating substantially all air spaces in the reinforcing fibrous layers and consolidating the resulting construct into a unitary product, illustrated in FIG. 12 with the addition of longitudinally extending support members 84, 86.

A method of fabricating and using footer products 10, 42 or 88 from the above-molded foam-based product is also herein disclosed. The molded footer members can be manufactured or fabricated at a production facility to create footer products 10, 42, or 88 and such fabricated footer products can then be transported to a work site by truck or rail. At the work site, a trench 16 is excavated around the outer perimeter of the dimensions of the building to be built. Trench 16 is dug to a depth respecting the depth of the frost line for the locale where the building is to be constructed. If no frost line is present in the locale, the trench 16 can be dug to local building code. The respective ones of prefabricated footer products 10, 42 or 88, as specified, are then positioned in trench 16. The respective footer products are assembled to each other and/or cut to length in trench 16 or can be assembled and cut to length on ground level and then be lowered and positioned in trench 16. At various corners in trench 16, the respective footer products are secured to each other as required. Such securement may include, for example and without limitation, support members such as longitudinal support members 84, 86 extending across a joint between adjacent such footer products, and fastened to each of the respective footer products so as to generally immobilize the respective footer products relative to each other, thereby creating the overall footer for the building construct. Various fasteners well known to those skilled in the art can be applied to such task of immobilizing the footer products. Once the footer products are correctly positioned and stabilized, an external load bearing wall can be immediately constructed on top of the so-assembled footer. There is no requirement to wait for any period of time, especially not several days for any material curing or hardening before the external walls can be constructed on top of the footer. Thus, a footer product 10, 42 or 88, which includes an insulating member 12, or a plurality of insulating members 44 and a first elongate insulating member 62, can facilitate the construction process by allowing the building to be constructed immediately after the footer has been emplaced.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

The invention claimed is:

1. In combination, (a) a wall; and (b) a footer below said wall, said footer being adapted to receive a load from said wall, said footer comprising (i) an elongate insulating member having an upper surface, a lower surface, a first side surface, a second side surface, and an interior bounded by said upper surface, said lower surface, and said first and second side surfaces, said elongate insulating member having a length, a width of about 4 inches to about 30 inches, a height of 2 inches to about 20 inches, and a density of about 2 pounds per cubic foot to about 40 pounds per cubic foot, said wall having a wall length extending along the length of said footer and a wall width extending in a same direction with the width of said footer, the width of said wall being less than the width of said footer, and (ii) a load distributing member attached to one of the upper surface and the lower surface of said elongate insulating member, said load distributing member made of a polymeric or fiber-reinforced polymeric material, said elongate insulating member having a first bending resistance, said load distributing member having a second bending resistance, greater than the first bending resistance.

2. A combination as in claim 1, said load distributing member comprising a first load distributing member attached to the upper surface of said elongate insulating member, a second load distributing member being attached to the lower surface of said elongate insulating member, said second load distributing member having a third bending resistance, greater than the first bending resistance.

3. A footer having a top and a bottom, and a length and a width, said footer being adapted to receive and bear a given load from an overlying construct, said footer comprising (a) a foam member having an upper surface, a lower surface, a first side surface, and a second side surface, and an interior bounded by said upper surface, said lower surface, and said first and second side surfaces, said foam member having a length, a width of about 4 inches to about 30 inches, a height of 2 inches to about 20 inches, and a density of about 2 pounds per cubic foot to about 40 pounds per cubic foot;

(b) a plurality of load-bearing intercostals extending through said foam member at multiple locations along the length and width of said foam member, and extending from at or proximate the top surface to at or proximate the bottom surface, said intercostals substantially enhancing load bearing capacity of said footer product, said foam member comprising a longitudinally-extending elongate foam member extending along the length of said footer, a first set of foam members abutting a first side of said longitudinally-extending elongate foam member; and a second set of foam members abutting a second side of said longitudinally-extending elongate foam member, said longitudinally-extending elongate foam member and said first and second sets of foam members comprising an assemblage having a length, a top, a bottom, and first and second sides, further comprising a reinforcing layer of fiber-reinforced polymeric material extending along the length of said assemblage and extending across the top, the bottom, and the first and second sides of said assemblage, thereby to wrap the top, the bottom, and the sides of said assemblage in said fiber-reinforced polymeric reinforcing layer and at least in part defining said intercostals.

4. A footer as in claim 3 wherein said intercostals further comprise pins, rods, rivets, and/or needles spaced from each other along the length and the width of said footer.

5. A footer as in claim 4 wherein at least some of said intercostals are uniformly spaced from each other along the length and width of said footer.

6. A footer as in claim 4 wherein spacing of said intercostals from each other varies along at least one of the length and the width of said footer.

7. A footer as in claim 3, comprising multiple said foam members adjacent respective ones of each other in at least one of side-by-side or end-to-end respective relationships, at least one layer of fibrous material, embedded with cured resin, extending across the top of said footer, downwardly along the left and right sides of respective ones of said foam members, and across the bottom of said footer.

8. A footer as in claim 7 wherein said fibrous material, in combination with embedded polymeric material, extends as ones of said intercostals along left and right sides of respective ones of said foam members, of said first and second sets of foam members, and wherein a given said intercostal extends along a substantial portion of the respective length, or width of said footer.

9. A footer as in claim 3, further comprising a plurality of said foam members, of said first and second sets of foam members, abutting each other end to end and collectively extending along the length of said footer.

10. A footer as in claim 9, said plurality of foam members, of said first and second sets of foam members, collectively extending along the full length of said footer.

11. A footer as in claim 3, each said foam member in said first and second sets of foam members having a top, a bottom, and left and right sides, layers of fiber-reinforced polymeric material extending across the top, the bottom, and the left and right sides of ones of said foam members of said first and second sets of foam members.

12. A combination as in claim 3, said wall having a second wall length extending along the length of said footer and a second wall width extending in a same direction with the width of said footer, the width of said wall being less than the width of said footer.

13. A footer as in claim 3 wherein said longitudinally-extending elongate foam member comprises one or more thermally-insulating foam blocks, and a reinforcing layer of fiber-reinforced polymeric material extending about said one or more foam blocks, including across a top, a bottom, and first and second sides of the respective said one or more foam blocks.

14. A footer as in claim 13, further comprising layers of fiber-reinforced polymeric material extending about each of said foam members in said first and second sets of foam members.

* * * * *